US005797179A

United States Patent [19]

Unger, III et al.

[11] Patent Number: 5,797,179

[45] Date of Patent: Aug. 25, 1998

[54] MACHINE FOR TERMINATING OFFSET CONNECTOR

[75] Inventors: Mark Elton Unger, III, Tower City; Dale Eugene Stough, Jr., Red Lion, both of Pa.

[73] Assignee: The Whitaker Corporation, Wilmington, Del.

[21] Appl. No.: 740,459

[22] Filed: Oct. 29, 1996

[51] Int. Cl.[6] ..... H01R 43/01; H01R 43/20

[52] U.S. Cl. ..... 29/753; 29/33 M; 29/755; 29/866

[58] Field of Search ..... 29/749, 751, 753, 29/755, 866, 33 M, 566.3, 760

[56] References Cited

U.S. PATENT DOCUMENTS

| | | | |
|---|---|---|---|
| 4,034,472 | 7/1977 | Cover et al. | 29/749 |
| 4,238,874 | 12/1980 | Chandler et al. | 29/33 M |
| 4,389,769 | 6/1983 | Casey | 29/751 |
| 4,470,181 | 9/1984 | Sergeant | 29/33 M |
| 4,476,628 | 10/1984 | Kees, Jr. | 29/755 X |
| 4,627,150 | 12/1986 | Burnett | 29/751 X |
| 4,642,873 | 2/1987 | Bower, Jr. et al. | 29/566.3 |
| 4,667,398 | 5/1987 | Leiby | 29/566.3 X |
| 4,718,167 | 1/1988 | Moore et al. | 29/861 |
| 4,831,727 | 5/1989 | Johnson, Jr. et al. | 29/749 X |
| 4,912,823 | 4/1990 | Shah et al. | 29/33 M |
| 5,075,963 | 12/1991 | Pawlenko | 29/861 |
| 5,099,570 | 3/1992 | Gerhard, Jr. | 29/753 |
| 5,456,005 | 10/1995 | Satoh et al. | 29/863 |

FOREIGN PATENT DOCUMENTS

| | | | |
|---|---|---|---|
| 2445084 | 4/1975 | Germany | 29/866 |

*Primary Examiner*—Peter Vo

[57] ABSTRACT

A machine (40) is disclosed for inserting discrete wires (100) of a cable (98) into insulation displacement contacts (20, 22) of a connector (10) having two mutually offset rows (16, 18) of contacts on the same side of the connector. The machine (40) includes first and second side by side insertion blades (238, 240) and a connector holder (48) that positions the connector to be terminated with respect to the two insertion blades. The first insertion blade (238) inserts wires into insulation displacement contacts (20) of the first row (16) of contacts and the second insertion blade (240) inserts wires in the contacts (22) of the second row (18) of contacts. A movable carriage (46) incrementally moves the connector holder (48) so that each of the contacts in the two rows are alternately positioned in alignment with their respective insertion blades for insertion of the wires. A wire guide member (204) is provided that temporarily deflects an already inserted wire (360) of the second row (18) to one side while inserting a wire (362) in the next adjacent contact (20") of the first row (16).

16 Claims, 14 Drawing Sheets

200
206
204
9
144
200
192
190
142
138
154
156
8
146
150
148
152
122
180
128
130
182
176
178
44
172
174
184
170
168
162
164
116
118
185
166

MACHINE FOR TERMINATING OFFSET CONNECTOR

The present invention relates to machines for inserting discrete wires of cables into insulation displacement contacts of connectors and more particularly to such machines for inserting wires into connectors having two mutually offset rows of contacts on the same side of the connector.

BACKGROUND OF THE INVENTION

Electrical cables such as those used in telephone communications usually consist of insulated color coded pairs of wires that are sometimes twisted to reduce cross-talk. Lengths of these cables are assembled with a male electrical connector terminated to one end and a female electrical connector terminated to the other end. The cables are used to interconnect various kinds of communications equipment. The electrical connectors utilize insulation displacement contacts so that during termination, the insulated wire is simply inserted into the desired contact which pierces the insulation and forcefully contacts the underlying conductor. For an example of such an electrical connector, see U.S. Pat. No. 3,760,335 which discloses an electrical connector having two rows of insulation displacement contacts, one row arranged on one side of the connector housing and the other row on the opposite side. Machines for cutting the wire to length and inserting it into the desired insulation displacement contact usually includes a connector holder and two insertion mechanisms having inserter blades positioned on opposite sides of the holder. The holder is movable so that each pair of opposite contacts can be momentarily positioned in alignment with the two inserter blades. See, for example, U.S. Pat. No. 4,238,874 which issued Dec. 16, 1980 to Chandler et al. and which is incorporated herein by reference. The connector holder of the machine is moved to position the first pair of contacts in alignment with the inserter blades. The operator then selects the first pair of wires to be inserted and manually slides each wire along a respective guideway until both wires contact a sensor, at which time the insertion mechanisms are activated so that the inserter blades move toward the connector, picking up the two wires, cutting them to length and inserting them in their respective contacts. These electrical connectors are beginning to be made smaller and more compact in keeping with the current trend in the electronics, computer, communications and related industries, to miniaturize components and interconnection devices. To further this goal, such a miniaturized electrical connector has been developed having two rows of insulation displacement contacts on the same side of the housing. Such a connector is shown in FIGS. 1 and 2 and identified as 10 and includes a housing 12, a plug portion 14, and two offset rows 16 and 18 of insulation displacement upper and lower contacts 20 and 22, respectively, extending from a common side of the housing 12. Every upper contact 20 includes a lead 24, as best seen in FIG. 2, that extends downwardly and interconnects with a respective contact trace 26 on one side of the plug portion 14. Every lower contact 22 includes a lead 28 that extends downwardly and interconnects with a respective contact trace 30 on the opposite side of the plug portion 14. Each upper contact 20 is paired to a respective lower contact 22 so that they are in mutual vertical alignment and their respective leads 24 and 28 and their respective contact traces 26 and 30 are directly opposite each other on opposite sides of the housing. The connector 10 is arrange so that pairs of wires can be terminated to pairs of upper and lower contacts, one wire being directly above the other. Both the upper and lower contacts are arranged on a center to center spacing of 0.031 inch resulting in a very compact and delicate structure. The machine described above and in the '874 patent is not suitable to terminate wires to this electrical connector without modifying the machine so that both insertion mechanisms are on the same side. This would necessitate stacking the two insertion mechanisms so that the insertion blades are in vertical alignment to match the pairs of contacts 20 and 22, however, this is deemed to be not practical.

What is needed is a machine for terminating wires to two offset rows of contacts positioned on the same side of a connector housing wherein the contacts are arranged in aligned pairs. Additionally, the machine must accommodate very small center to center contact spacing and allow insertion of the wires in seriatim while preventing damage to adjacent wires already inserted.

SUMMARY OF THE INVENTION

A machine is disclosed for inserting discrete wires of a cable into insulation displacement contacts of an electrical connector. The connector includes first and second spaced rows of the contacts on a common side thereof. The machine includes a frame and first and second inserting mechanisms. The first inserting mechanism has a first insertion blade movable in a first direction for effecting the inserting of the discrete wires into the contacts of the first row. The second inserting mechanism is adjacent to and spaced from the first inserting mechanism and has a second insertion blade movable in the first direction for effecting the inserting of the discrete wires into the contacts of the second row. A holder is slidingly coupled to the frame and arranged to hold and incrementally move the connector in second and third opposite directions along a pathway perpendicular to the first direction to momentarily position each contact in the first row in alignment with the first insertion blade and to momentarily position each contact in the second row in alignment with the second insertion blade.

DESCRIPTION OF THE PREFERRED EMBODIMENT

Figure 1:
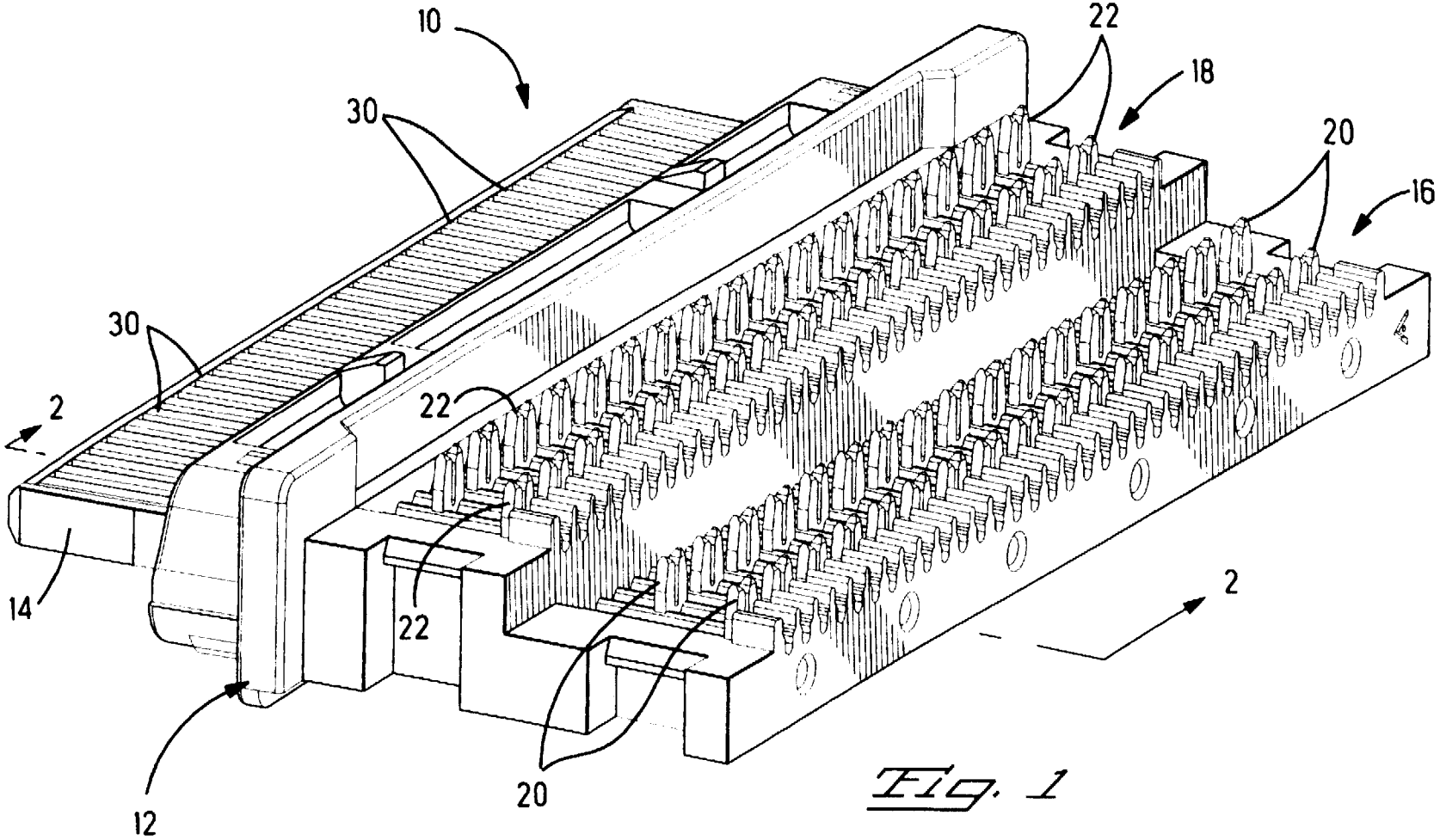
FIG. 1 is an isometric view of an electrical connector of the type to which wires may be terminated by the machine of the present invention.
Figure 3:
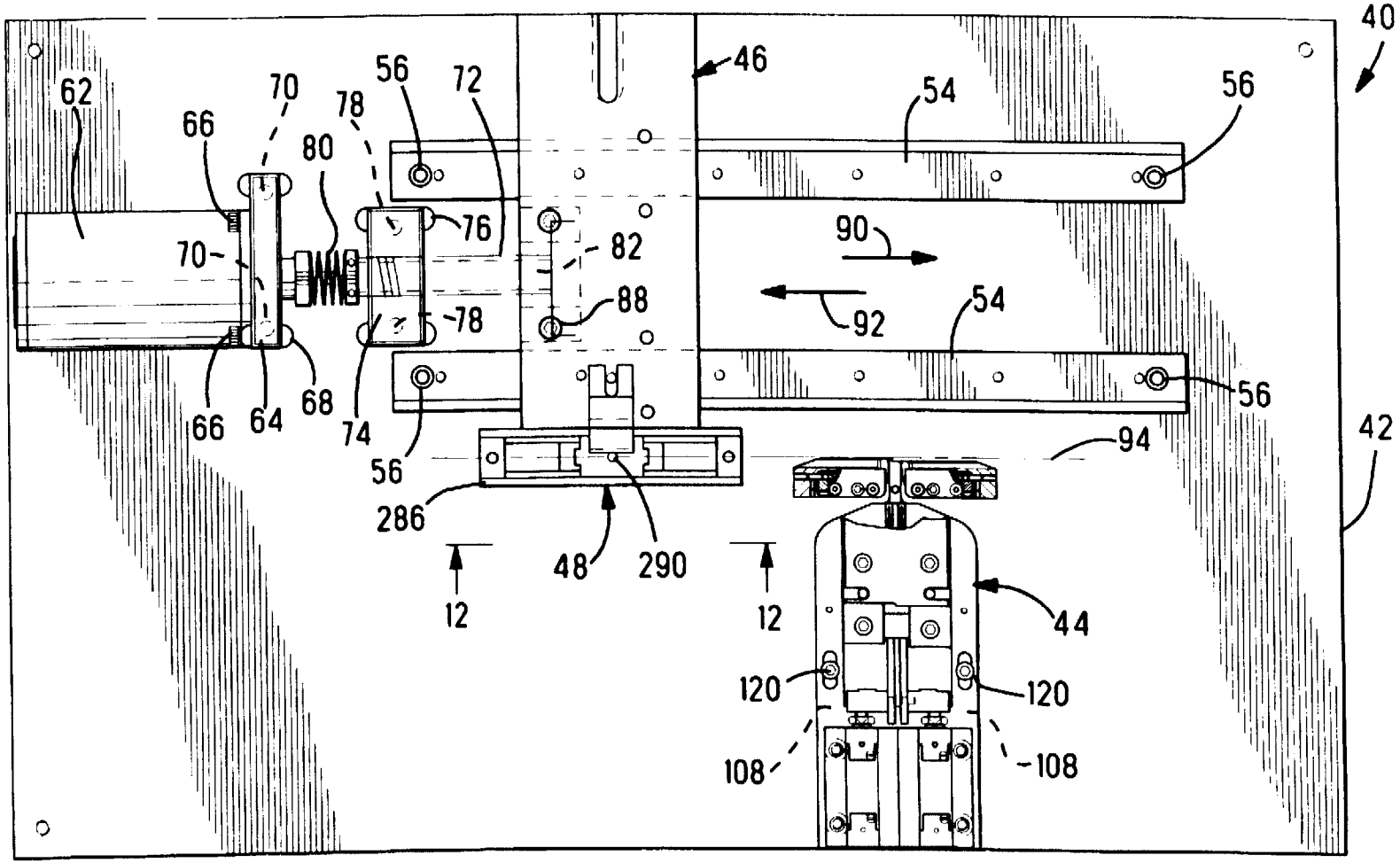
FIG. 3 is a plan view of a machine incorporating the teachings of the present invention.
Figure 4:
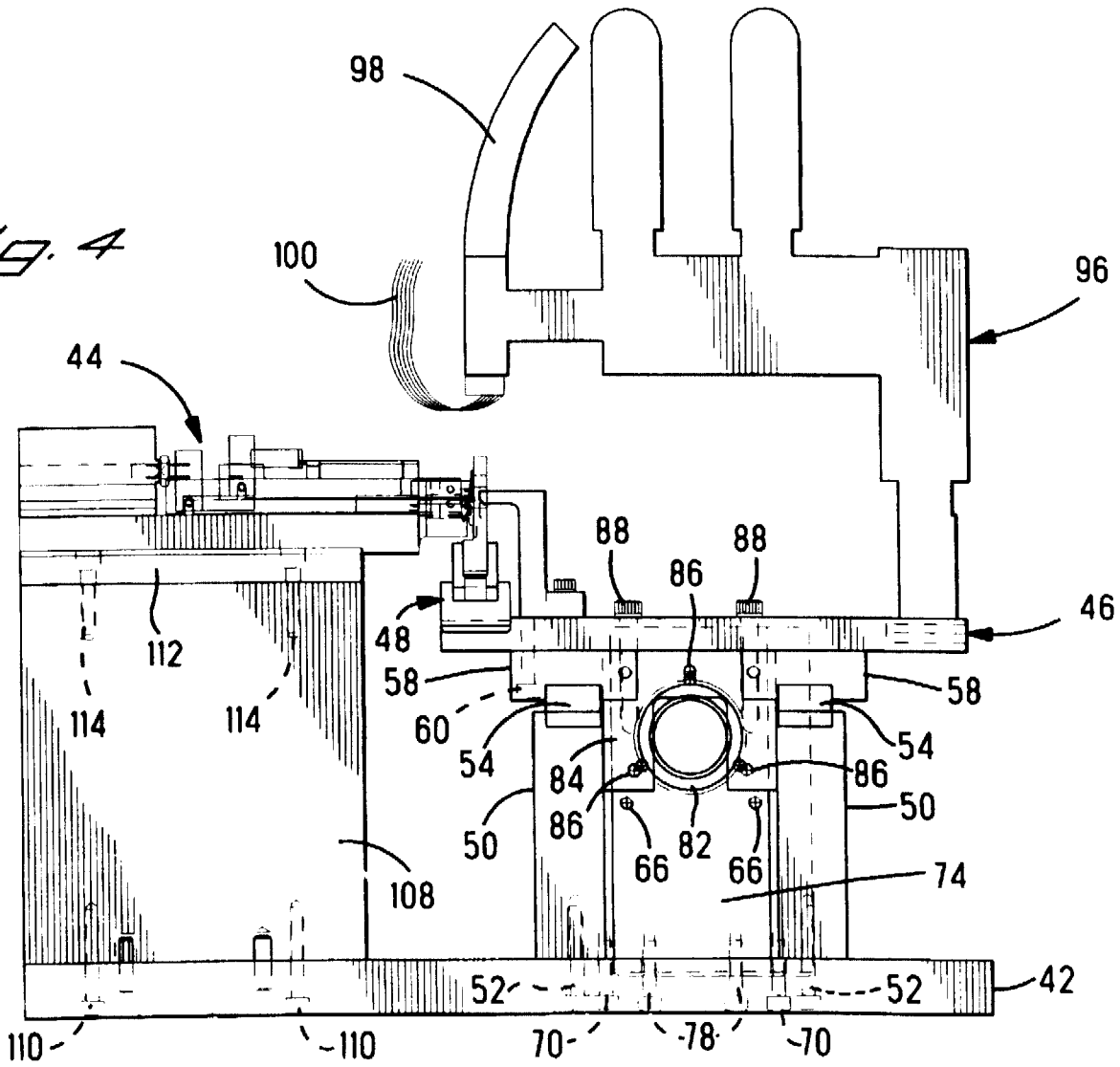
FIG. 4 is a side view of the machine shown in FIG. 3.

There is shown in FIGS. 3 and 4 a machine 40 for cutting wires to length and inserting them into the insulation displacement contacts 20 and 22 of the connector 10 shown in FIG. 1. The machine 40 includes a frame 42, a wire insertion mechanism 44, a movable carriage 46, and a connector holder 48 that is attached to the carriage. The frame 42 includes a pair of support rails 50 attached thereto by means of screws 52 threaded into holes in the support rails, as shown in FIG. 4. The stationary portion 54 of a slide is attached to the top surface of each support rail 50 by means of screws 56 that are threaded into holes in the support rails, as best seen in FIG. 3. The movable portion 58 of each slide is attached to the under side of the carriage 46 by means of screws 60 that extend through holes in the movable portion and into threaded holes in the carriage, as shown in FIG. 4. A motor 62 is attached to a support bracket 64 by means of four screws 66 that extend through holes in a flange of the motor and into threaded holes in the support bracket. The support bracket 64 is nested in a recess 68 formed in the frame 42, as best seen in FIG. 3, and secured in place by means of screws 70 which extend through holes in the frame and are threaded into holes in the support bracket, as shown in FIG. 4. A lead screw 72 extends through and is supported in a support block 74 so that it is free to rotate without moving axially. The support block 74 is nested in a recess 76 formed in the frame 42 and secured in place by means of screws 78 which extend through holes in the frame and are threaded into holes in the support block. One end of the lead screw is coupled to the motor shaft through a flexible coupling 80 in the usual manner. The other end of the lead screw threadingly engages a flanged nut 82 that is secured to a U-shaped bracket 84 by means of the screws 86 which extend through clearance holes in the flange and into threaded holes in the bracket. The U-shaped bracket is attached to the under side of the carriage 46 by means of screws 88 that extend through holes in the carriage and into threaded holes in the U-shaped bracket. The motor is arranged to rotate the lead screw 72 in one direction thereby moving the carriage 46 to the right, as viewed in FIG. 3 and indicated by the arrow 90, and in the other direction thereby moving the carriage to the left, as indicated by the arrow 92. Since the connector holder 48 is attached to and carried by the carriage 46, it is moved back and forth along the pathway 94, as best seen in FIG. 3. A cable clamping mechanism 96 is attached to and carried by the carriage 46. The cable clamping mechanism is arrange to clamp an electrical cable 98 having a plurality of wires 100 extending from and end thereof, and to position the wires vertically above the connector holder 48, as shown in FIG. 4.

Figures 5, 6:
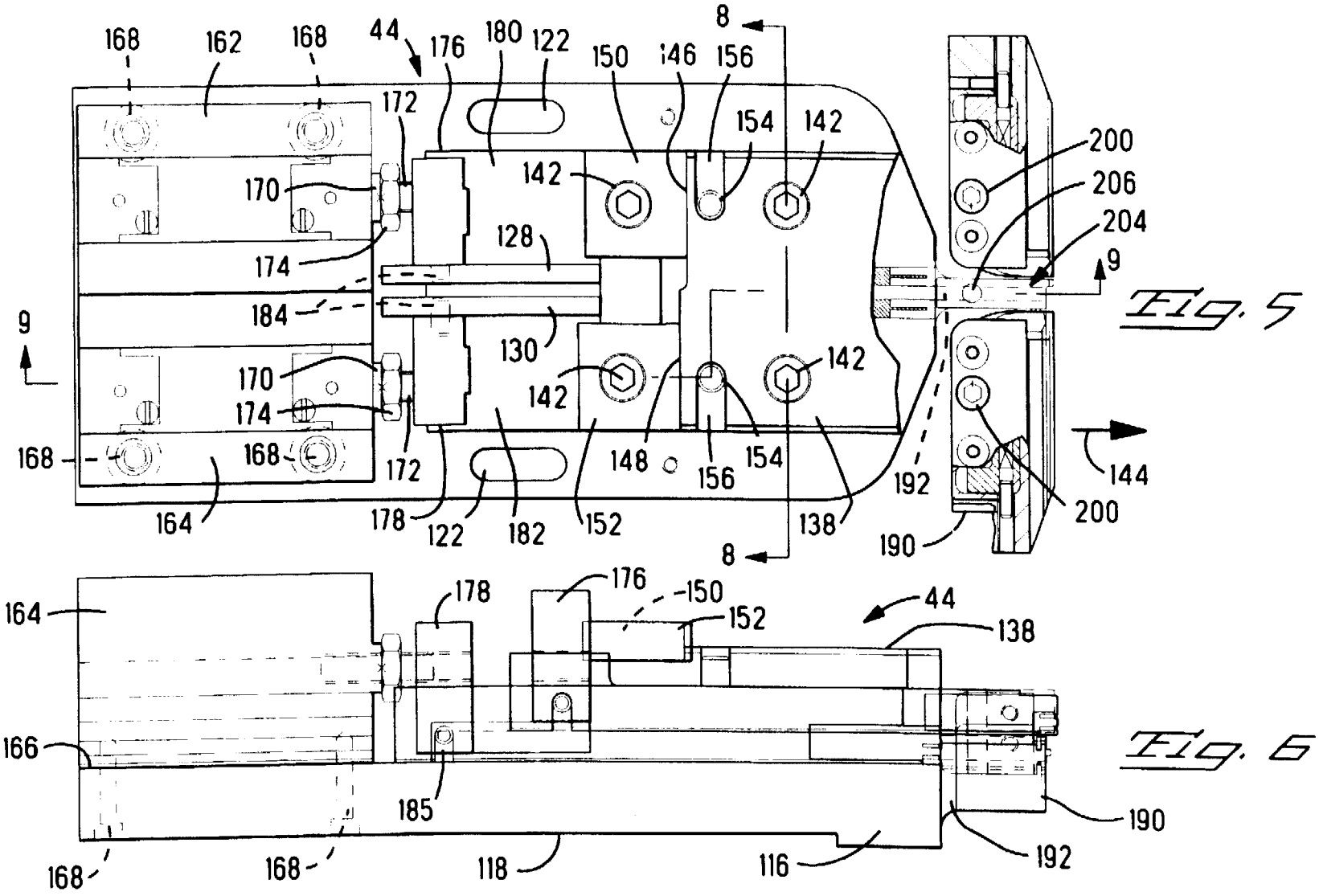
FIGS. 5 and 6 are plan and side views, respectively, of the insertion mechanism shown in FIGS. 3 and 4.

As shown in FIG. 4, the wire insertion mechanism 44 is attached to and supported by a pair of upright plates 108 that are attached to the frame 42 by means of screws 110 extending through holes in the frame and into threaded holes in the two upright plates. A top plate 112 is secured to the upper surfaces of the two upright plates 108 by means of screws 114 that extend through holes in the top plate and into threaded holes in the two upright plates. This top plate 112 supports the wire insertion mechanism 44, which will now be described in detail. As shown in FIGS. 5 and 6, the wire insertion mechanism 44 includes a mounting plate 116 having a mounting surface 118 that is in engagement with the upper surface of the top plate 112 and attached thereto by means of screws 120 that extend through elongated holes 122 in the mounting plate 116, as best seen in FIG. 3, and into threaded holes in the top plate.

Figure 8:
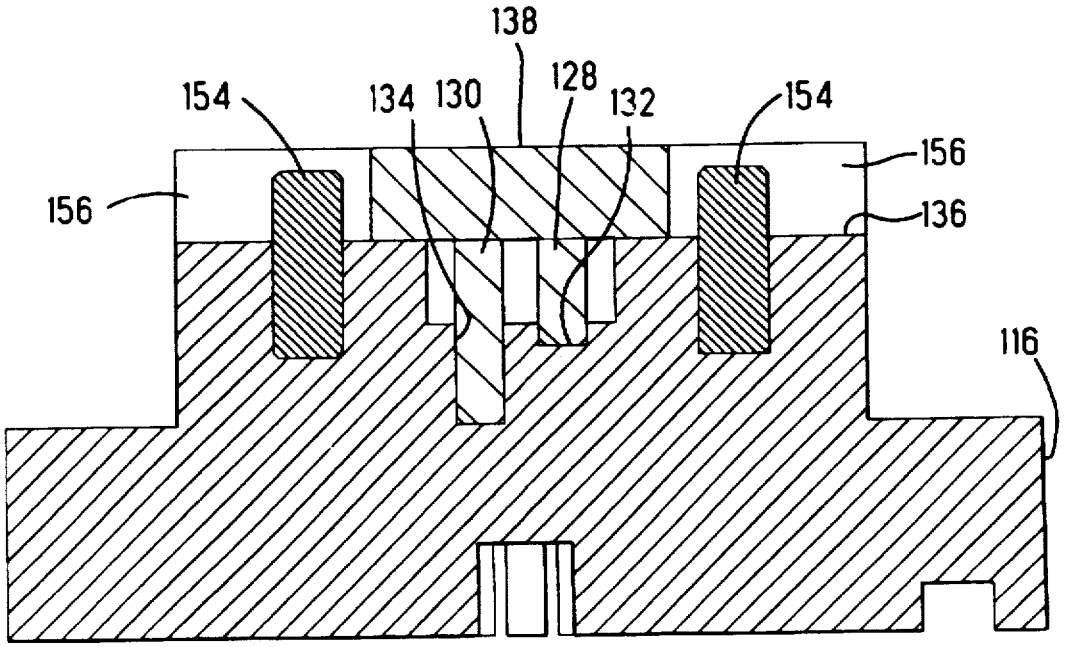
FIG. 8 is a cross-sectional view taken along the lines 8—8 in FIG. 5.
Figure 9:
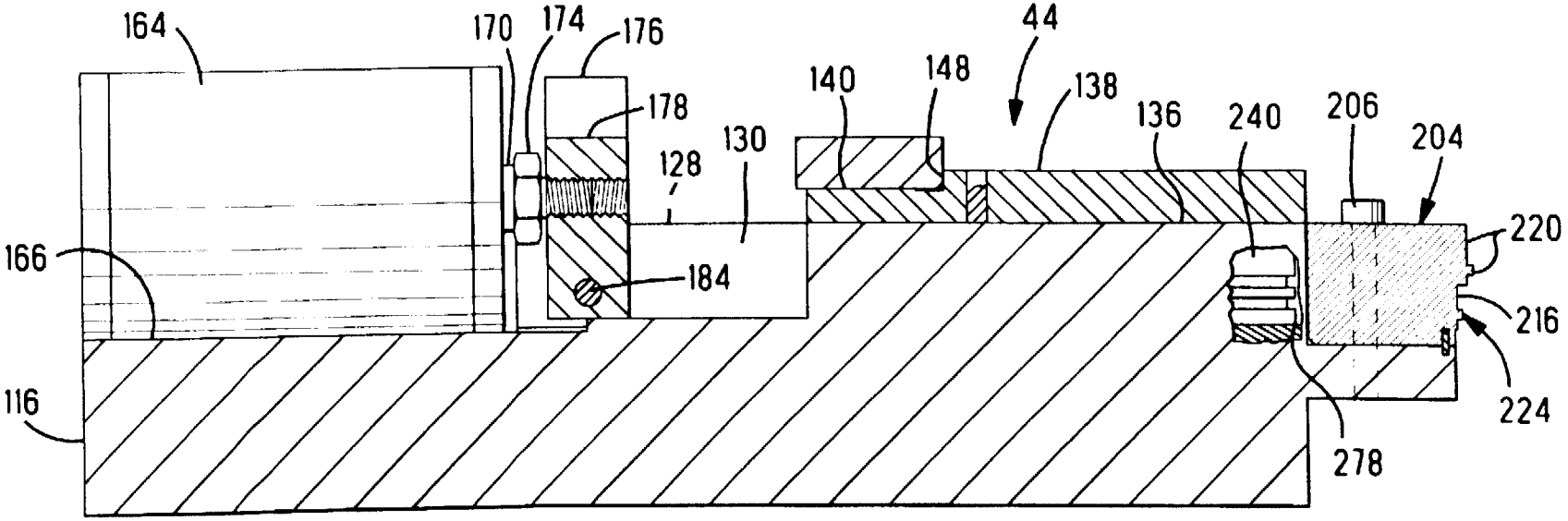
FIG. 9 is a cross-sectional view taken along the lines 9—9 in FIG. 5.

Left and right inserters 128 and 130, shown in FIG. 5 are arranged in left and right slots 132 and 134, respectively, that are formed in the upper surface 136 of the mounting plate 116, as best seen in FIG. 8. A cover plate 138 having a recess 140, as shown in FIGS. 5 and 9, is attached to the surface 136 by means of screws 142 that extend through holes in the cover plate and into threaded holes in the mounting plate 116. The cover plate retains the left and right inserters 128 and 130 in their respective left and right slots 132 and 134, yet allows the two inserters to slide freely within the slots in a first direction, indicated by the arrow 144 in FIG. 5 and in an opposite direction, without appreciable lateral play. The recess 140 in the cover plate 138, as shown in FIG. 9, terminates in left and right shoulders 146 and 148, respectively, the shoulder 146 being displaced toward the right with respect to the shoulder 148, as viewed in FIG. 5. Left and right stop blocks 150 and 152, respectively, are disposed in the recess 140 against their respective shoulders 146, 148 and secured in place with two of the screws 142, for a purpose that will be explained. A pair of pins 154 are pressed into holes in the mounting plate 116 and extend through closely formed open ended slots 156 formed in the cover plate 138 for accurately locating the cover plate and attached stop blocks 150 and 152. Left and right cylinders 162 and 164 are attached to a surface 166 of the mounting plate 116 by means of screws 168 that extend through holes in the mounting plate and into threaded holes in the bottom of each cylinder, as shown in FIGS. 5 and 6. Each left and right cylinder includes a piston rod 170 having a threaded hole formed axially in its end. A stud 172 extends from each threaded hole and is secured from rotation by means of a lock nut 174 that is tightened against the end of the piston rod. The studs 172 of the left and right cylinders are threaded into holes in left and right coupling blocks 176 and 178, respectively. The left and right coupling blocks ride on flat surfaces 180 and 182 adjacent the left and right inserters 128 and 130, respectively, that are formed in the mounting plate 116. Each left and right coupling block 176 and 178 has a pin 184 extending outwardly therefrom that engages a vertically formed slot 185 in a respective left and right inserter 128 and 130, as best seen in FIG. 6. As the air cylinder 162 is actuated to extend its piston 170, the left coupling block 176 slides along the surface 180, carrying the left inserter 128 in the first direction 144 to its extended position shown in FIG. 6. Movement of the left coupling block 176 is limited by the stop block 150 which is abuttingly engaged by the coupling block. When the left cylinder is actuated to retract its piston rod 170, the left coupling block slides back along the surface 180 thereby retracting the left inserter 128 to the starting position, or fully retracted position, shown in FIG. 5. Similarly, when the right cylinder 164 is actuated in one direction, its piston rod 170 will extend to move the right coupling block 178 and right inserter 130 in the first direction 144 until the right coupling block abuttingly engages the right stop block 152, and when actuated in the other direction, its piston rod will retract to move the right coupling block and right inserter to its starting position, as shown in FIG. 5.

Figure 2:
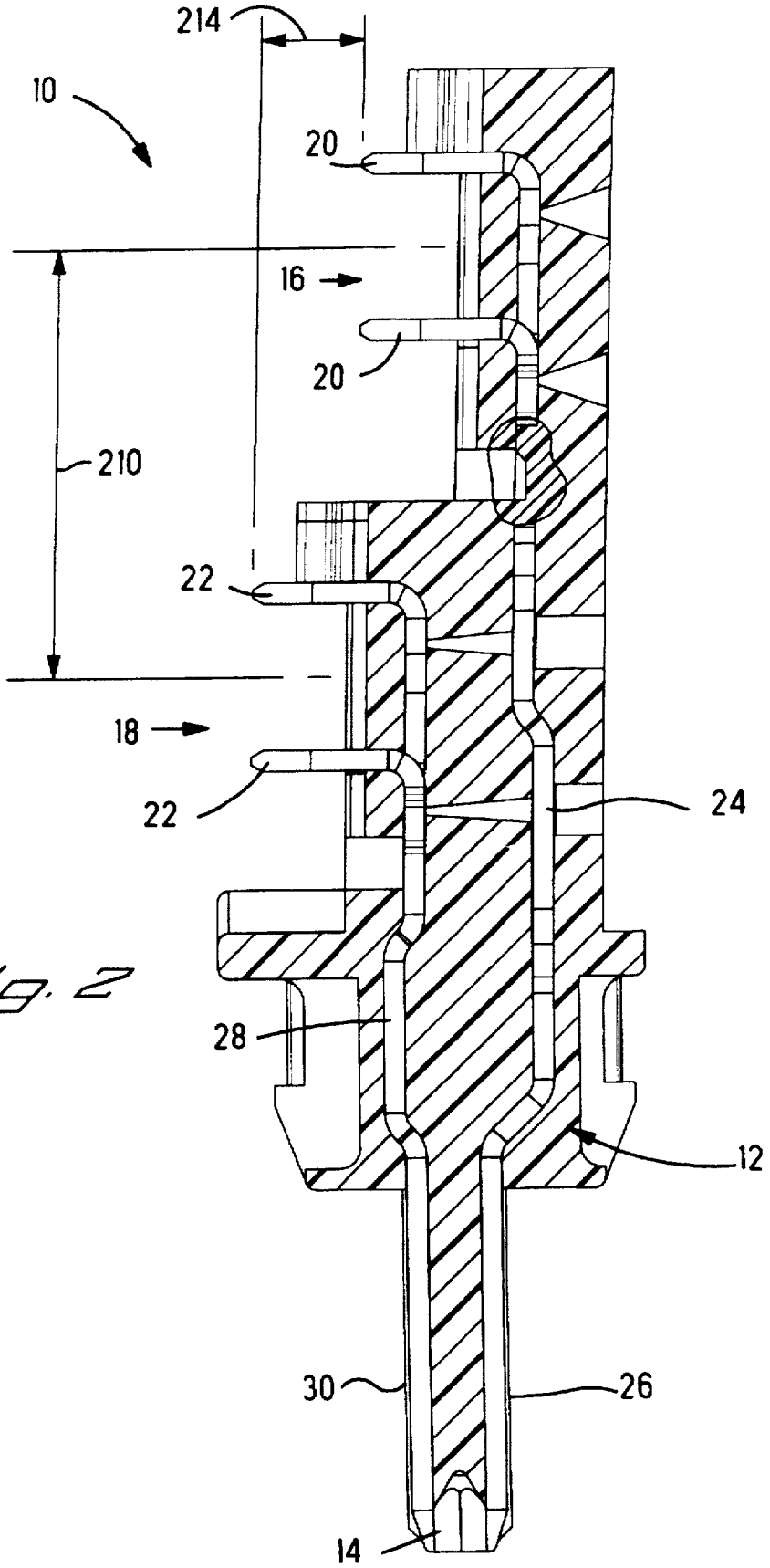
FIG. 2 is an end view of the connector shown in FIG. 1.
Figure 7:
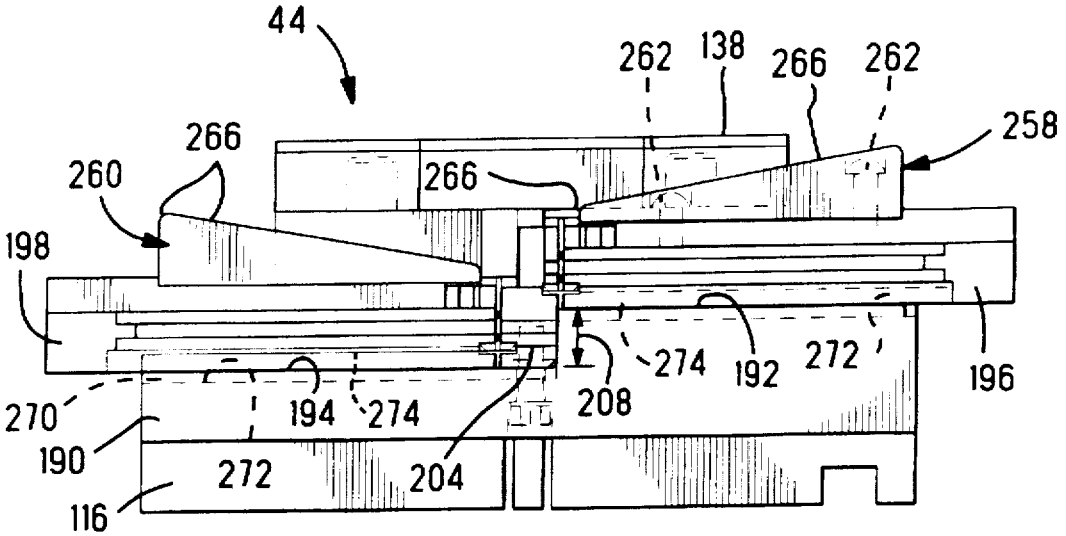
FIG. 7 is an end view of the insertion mechanism shown in FIG. 5.
Figure 11:
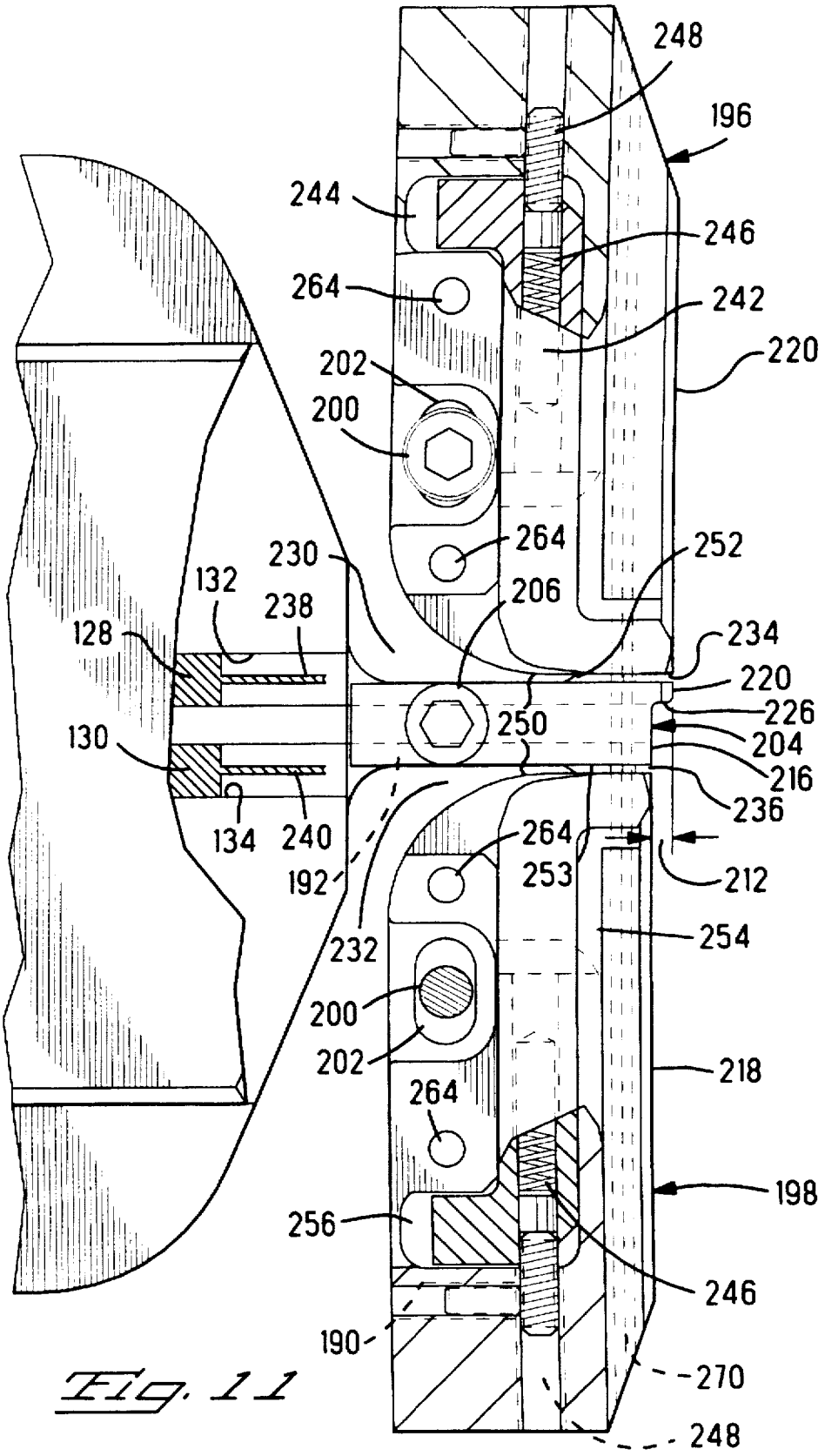
FIG. 11 is an enlarged view of a portion of that shown in 3.

The mounting plate 116 includes a T-shaped end 190, as best seen in FIGS. 5, 6, 7, and 11, having a narrow portion 192. As shown in FIG. 7, the T-shaped end 190 has left and right upwardly facing surfaces 192 and 194, respectively. Left and right offset housings 196 and 198 are attached to the left and right surfaces 192 and 194, respectively, by means of screws 200 which extend through elongated holes 202 in the left and right housings and into threaded holes in the T-shaped end 190. A guide member 204 is disposed on the narrow portion 192 and secured in place by means of a screw 206 that extends through a hole in the guide member and into a threaded hole in the narrow portion, as best seen in FIG. 9. Note that the left and right upwardly facing surfaces 192 and 194 are vertically offset by an amount 208 that corresponds to the vertical distance 210 between the centers of the two rows 16 and 18 of contacts, as shown in FIG. 2. Further, the left and right offset housings 196 and 198 are offset by an amount 212, as shown in FIG. 11, that corresponds to the horizontal distance 214 between the contacts 20 and the contacts 22, as shown in FIG. 2. The purpose of these offset amounts 208 and 212 is to provide sufficient support and guidance for the wires during their insertion into the two offset rows of contacts. The guide member 204 includes a forward facing surface 216 that is flush with an outer surface 218 of the right offset housing 198. The guide member also includes a projection 220 adjacent the left offset housing that extend outwardly so that it is flush with an outer surface 220 of the left offset housing 196, as best seen in FIG. 11. The forward surface 216 and the projection 220 of the guide member 204 have a profile 224, best seen in FIG. 9, that conforms somewhat to the profile of the contact side of the connector 10, shown in FIG. 2, for providing support and guidance to the connector when moving the connector during operation of the machine 40 and for supporting and guiding the wire during insertion thereof. The projection 220 includes a wire deflecting surface 226, as shown in FIG. 11, for a purpose that will be explained.

A left inlet 230 is formed between the left offset housing 196 and the left side of the guide member 204 and a right inlet 232 is formed between the right offset housing 198 and the right side of the guide member, as best seen in FIG. 11. The left and right inlets 230 and 232 terminate in narrow left and right passageways 234 and 236, respectively, that are just wide enough to receive a wire that is being inserted into contacts of the connector 10. The width of the passageways can be adjusted by loosening the screws 200, moving the left and right offset housings a desired amount, and then retightening the screws. The left and right inserters 128 and 130 have left and right insertion blades 238 and 240, respectively, as best seen in FIG. 11, that align with the left and right passageways 234 and 236, respectively. Each insertion blade is narrow enough to pass into and through its respective passageway when the piston rods 170 of the cylinders 162 and 164 are extended. A wire drag member 242 is disposed in a recessed pocket 244 formed in the top surface of the left offset housing 196, as shown in FIG. 11, and is urged toward the guide member 204 by means of a spring 246 disposed in a hole in the drag member. When a wire is moved into the passageway 234 from the inlet 230, it engages an angled surface 250 on the drag member, causing the drag member to move away from the guide member 204 a slight amount, against the urging of the spring 246. As the wire moves into the passageway 234 it is held between the guide member 204 and a parallel surface 252 on the end of the drag member 242. A set screw 248 is arranged in a threaded hole in the end of the left offset housing 196 in alignment with the spring. By turning the set screw 248 the spring can be made to provide more or less force thereby adjusting the amount of drag on the wire. Similarly, the right offset housing 198 includes a wire drag member 254 in a recessed pocket 256 formed in the top surface of the housing 198. The wire drag member 254 includes the angled surface 250 and parallel surface 252 that are adjacent the guide member 204 and right passageway 236, and operate to provide drag to a wire that is moved into the passageway 236 in a manner similar to wire drag member 242. Left and right covers 258 and 260 are attached to the left and right offset housings, respectively, as best seen in FIG. 7, by means of screws 262 that extend through holes in the covers and into threaded holes 264 formed in the two offset housings, shown in FIG. 11. The left and right covers 258 and 260 include smoothly beveled and radiused outer surfaces 264 that allow a wire to be easily moved through the left and right inlets 230 and 232 and into the passageways 234 and 236 without snagging or other hinderance.

Figure 10:
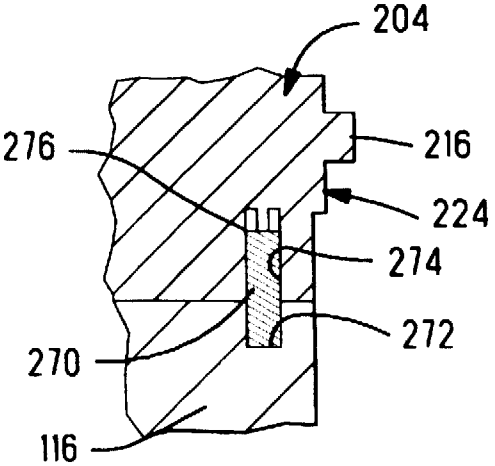
FIG. 10 is an enlarged view of a portion of that shown in FIG. 9 showing a wire cutting anvil.

As shown in FIGS. 9 and 10, a lower wire shear 270 is disposed in a lower slot 272 formed in the mounting plate 116 and a matching upper slot 274 formed in the guide member 204 and the left and right offset housings 196 and 198. The lower wire shear 270 includes a lower shear edge 276 that face upwardly and toward the inserters 128 and 130. Each of the left and right inserters 128 and 130 has an upper shear edge 278, as best seen in FIG. 9, that shearingly engages the lower shear edge 276 to sever a wire to length prior to insertion into the contacts of the connector 10.

Figure 13:
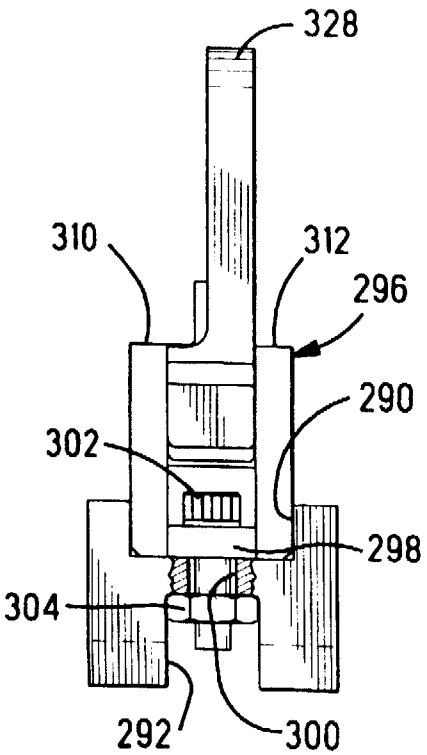
FIG. 13 is an end view of the connector holder shown in FIG. 12.
Figure 12:
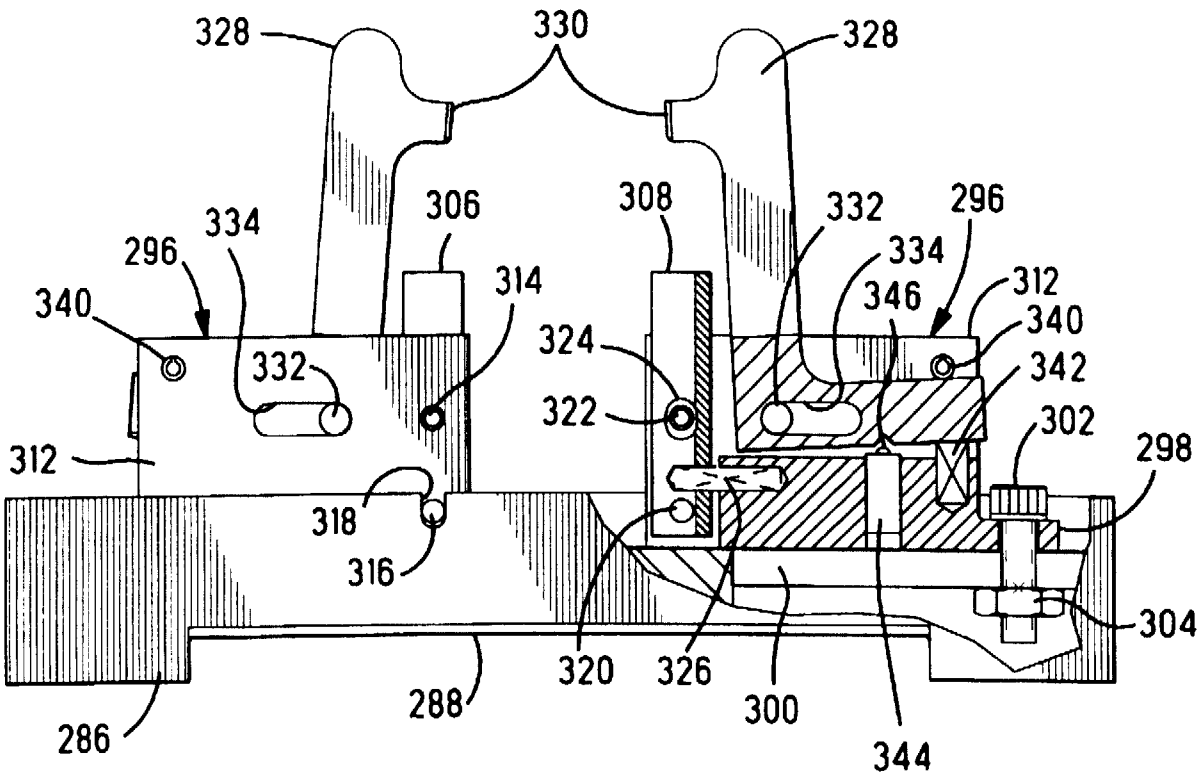
FIG. 12 is a front view in partial cross-section of the connector holder taken along the lines 12—12 as shown in FIG. 3.
Figure 14:
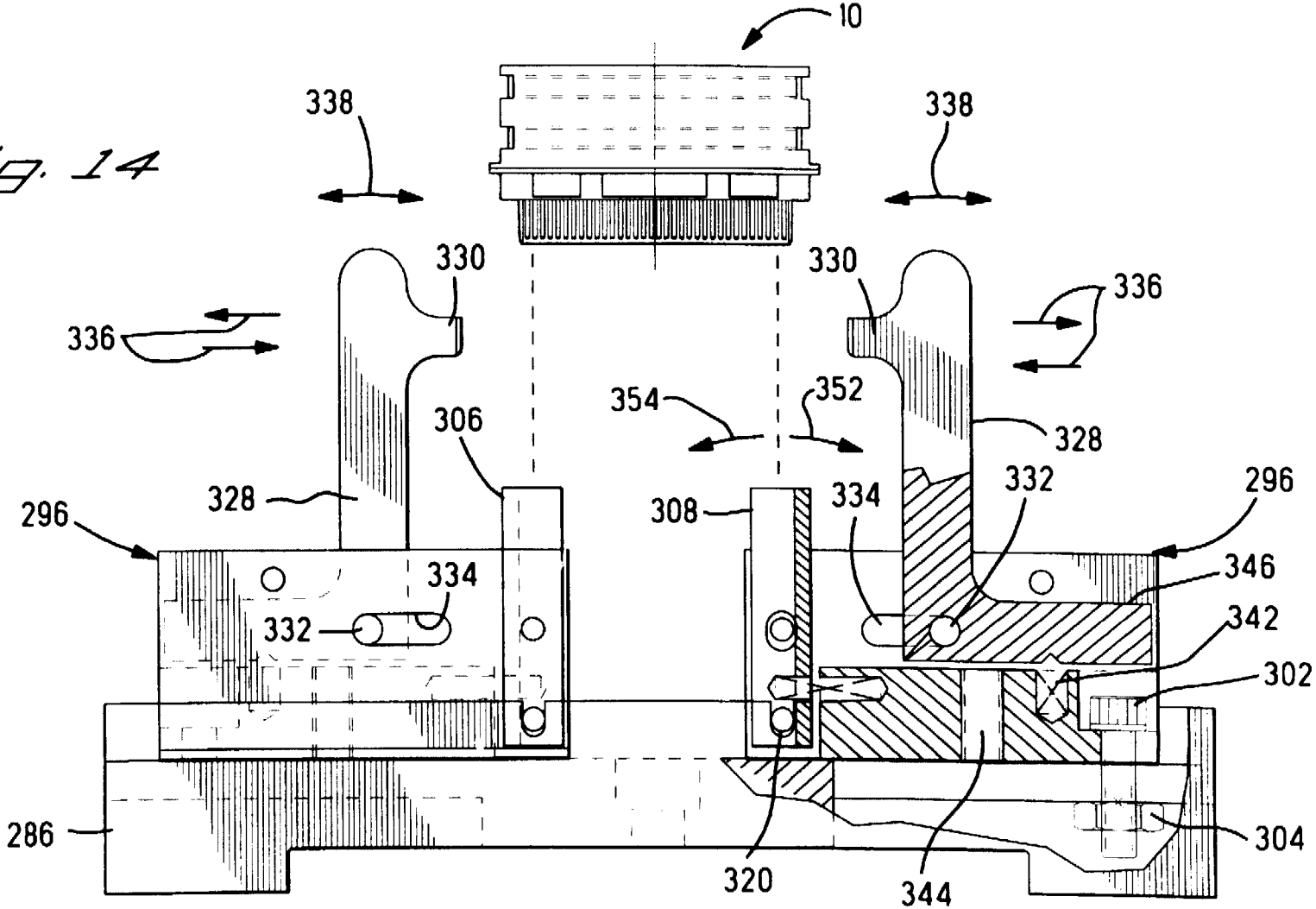
FIG. 14 is a front view of the connector holder ready to receive a connector.

The connector holder 48, as shown in FIGS. 3, 12, and 13, includes a base 286 having a recess 288 that snugly receives the end of the carriage 46 for locating the connector holder with respect to the pathway 94. A screw 290, as shown in FIG. 3, extends through a hole in the holder 48 and into a threaded hole in the carriage 46 to secure the holder thereto. The base 286 includes a downwardly facing slot 294 and an upwardly facing slot 296, both of which run the length of the base. A pair of U-shaped members 296 are slidingly received in the upwardly facing slot 296, in opposite ends of the slots shown in FIG. 12. Each U-shaped member includes a mounting flange 298 having a hole therethrough in alignment with an open ended elongated hole 300 in each end of the base formed through the web between the upwardly and downwardly facing slots. Screws 302 extending through the holes in the two flanges and through their respective elongated slots each have a nut 304 threaded thereon for securing the two U-shaped members in there respective ends of the slot 296. left and right connector nests 306 and 308 are arranged between to upwardly extending flanges 310 and 312 of the two U-shaped members 294 so that the connector nests are in opposing relationship, as best seen in FIG. 12. The left connector nest 306 is held in position by means of two pins 314 and 316 that extend through the nests and the flanges 310 and 312 of the left U-shaped member. The pin 316, additionally, extend into a locating slot 318 formed in the side wall of the base 286, as best seen in FIG. 12. The right connector nest 308 is pivotally attached to its right U-shaped member 296 by means of a pin 320 extending through holes in the nest and the two flanges 310 and 312. Another pin 322 extends through a press fit hole in the nest 308 and through enlarged holes 324 formed in the two flanges 310 and 312. This allows the right nest to pivot somewhat about the pin 320. A spring 326 is disposed in blind holes in the right U-shaped member 296 and the right connector nest 308, as best seen in FIG. 12, and urges the nest to pivot counterclockwise, for a purpose that will be explained. An L-shaped hold down arm 328 is positioned in each U-shaped member 296 between the two flanges 310 and 312. Each arm 328 includes a connector engaging hold down finger 330, the two hold down fingers being in mutual opposition as shown in FIG. 12. Each arm 328 has a pin 332 extending therethrough that also extends through elongated holes 334 formed in the two flanges 310 and 312. This permits free sliding movement of the L-shaped hold down arms, as indicated by the arrows 336, back and forth between the flanges 310 and 312 within the limits of the elongated holes 334 while allowing a small amount of pivotal movement as indicated by the arrows 338, as shown in FIG. 14. This pivotal movement of the two L-shaped arms is limited by a stop pin 332 that extends between the two flanges 310 and 312 of each U-shaped member 296 and blocks the path of movement of the arms. A spring 342 is disposed in a blind hole formed in each of the U-shaped members 296 and is in engagement with the arm 328 so that the arm is urged to pivot toward the opposing arm 328. A ball plunger 344 is disposed in a hole in the bottom of each U-shaped member and engages an indentation in the arm 328 to serve as a detent when sliding the arms toward each other to engage a connector.

Figure 16:
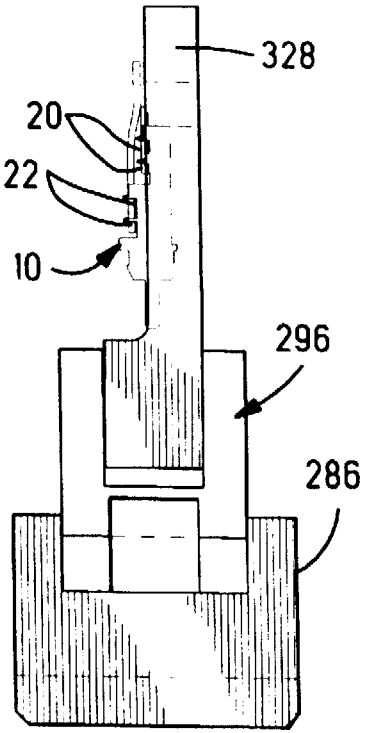
FIGS. 15 and 16 are front and end views, respectively, showing the connector in position within the connector holder.
Figure 15:
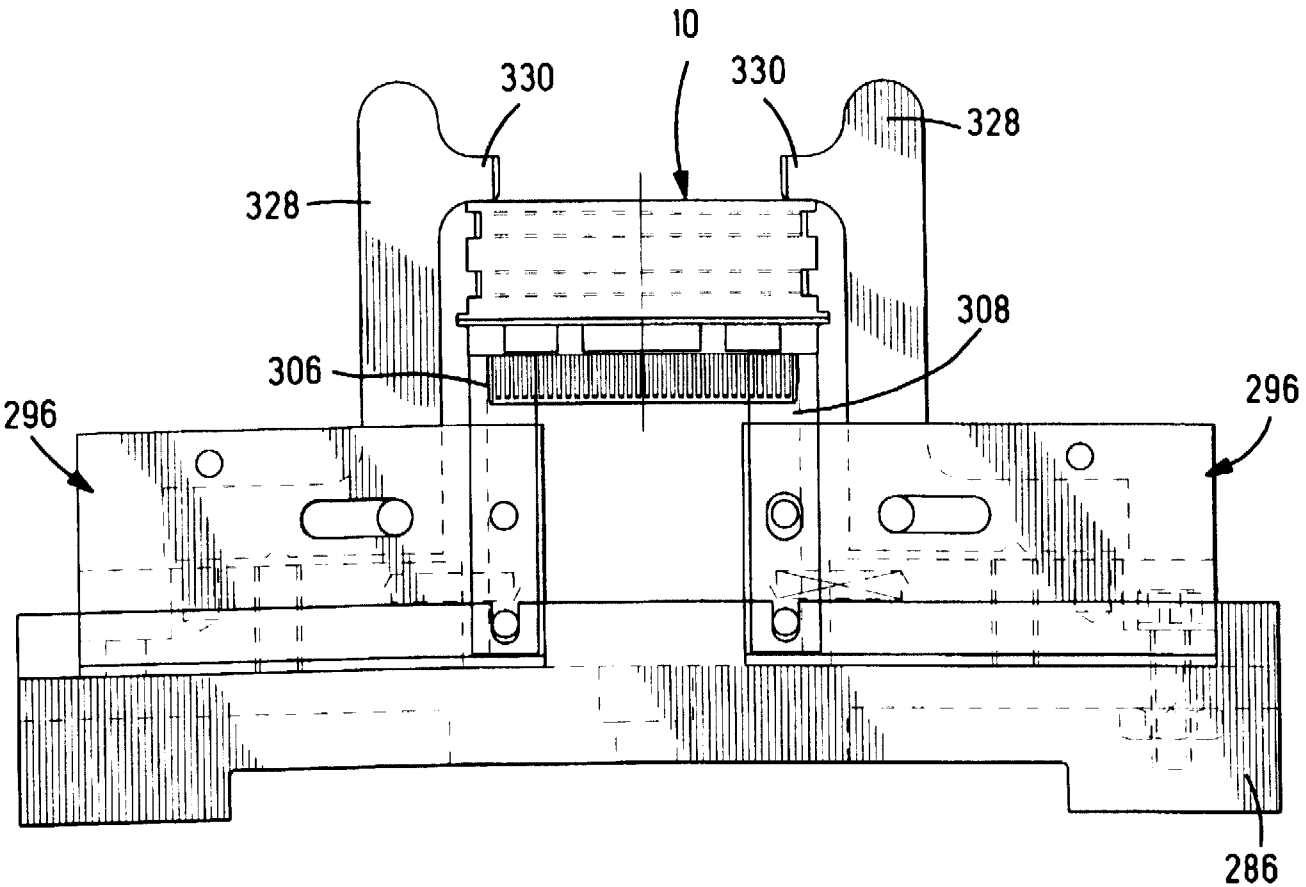
Figure 17:
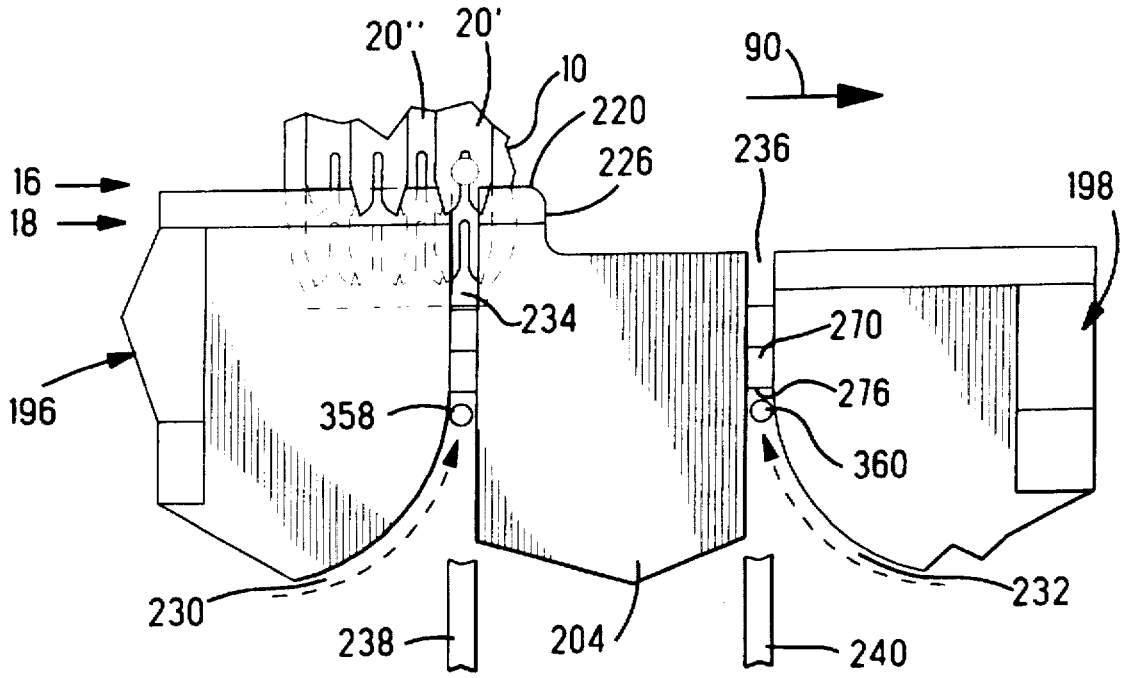
FIGS. 17 through 20 are top views of a portion of the insertion mechanism and connector showing various operating positions.
Figure 18:
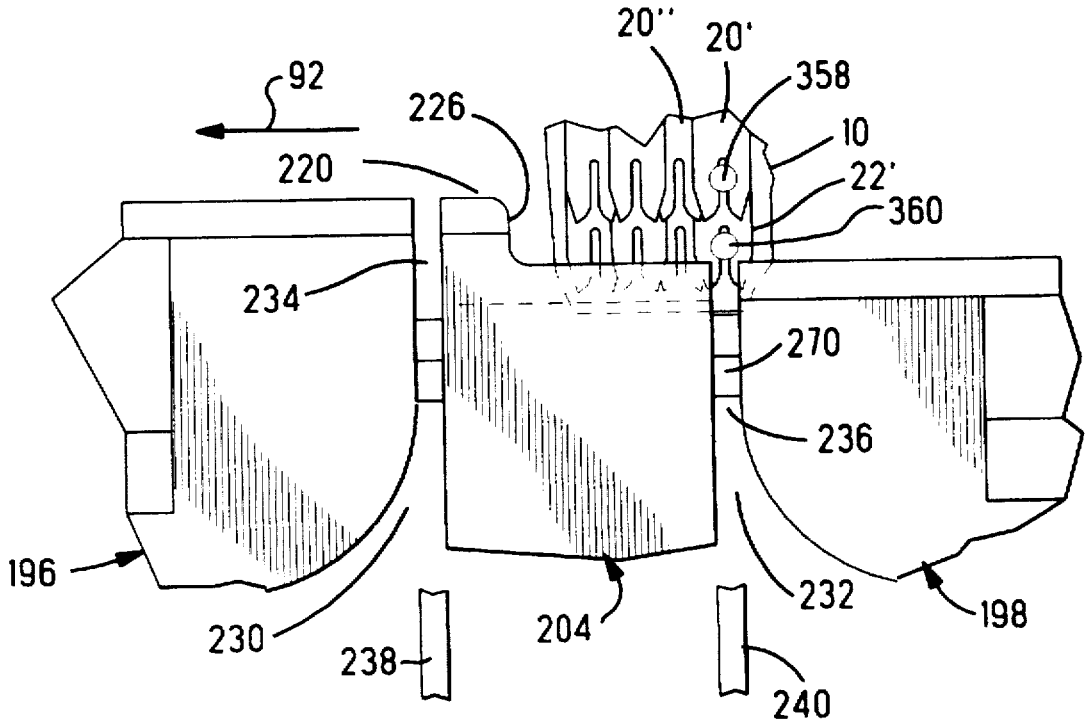
Figure 19:
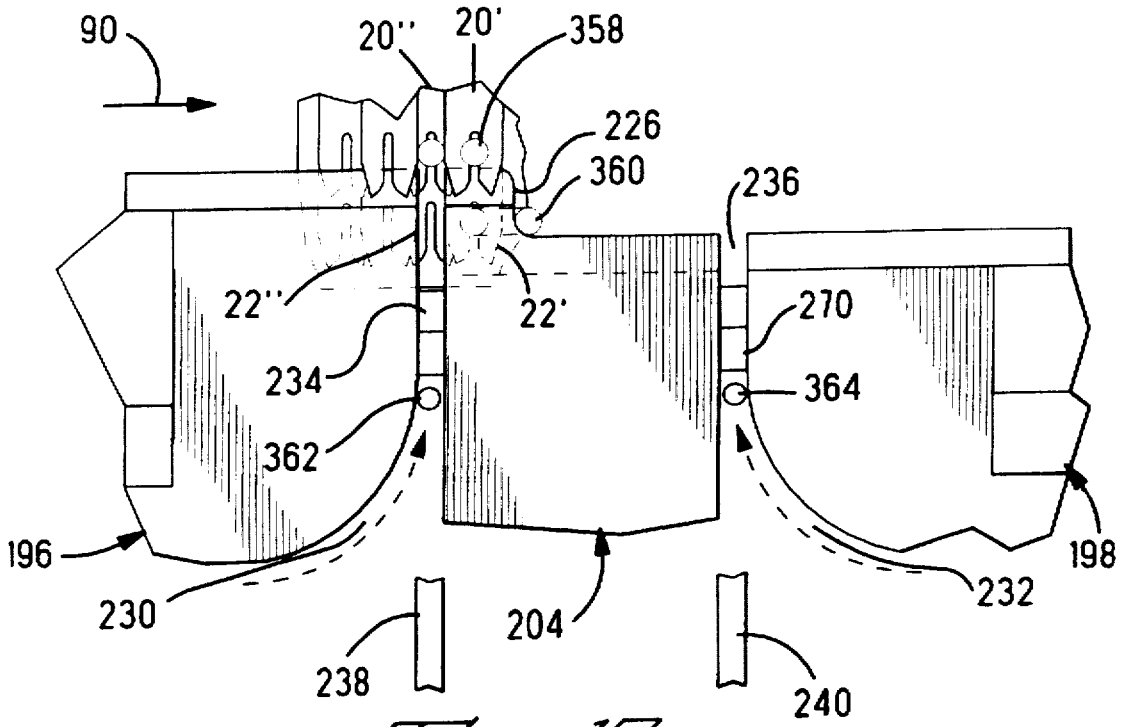
Figure 20:
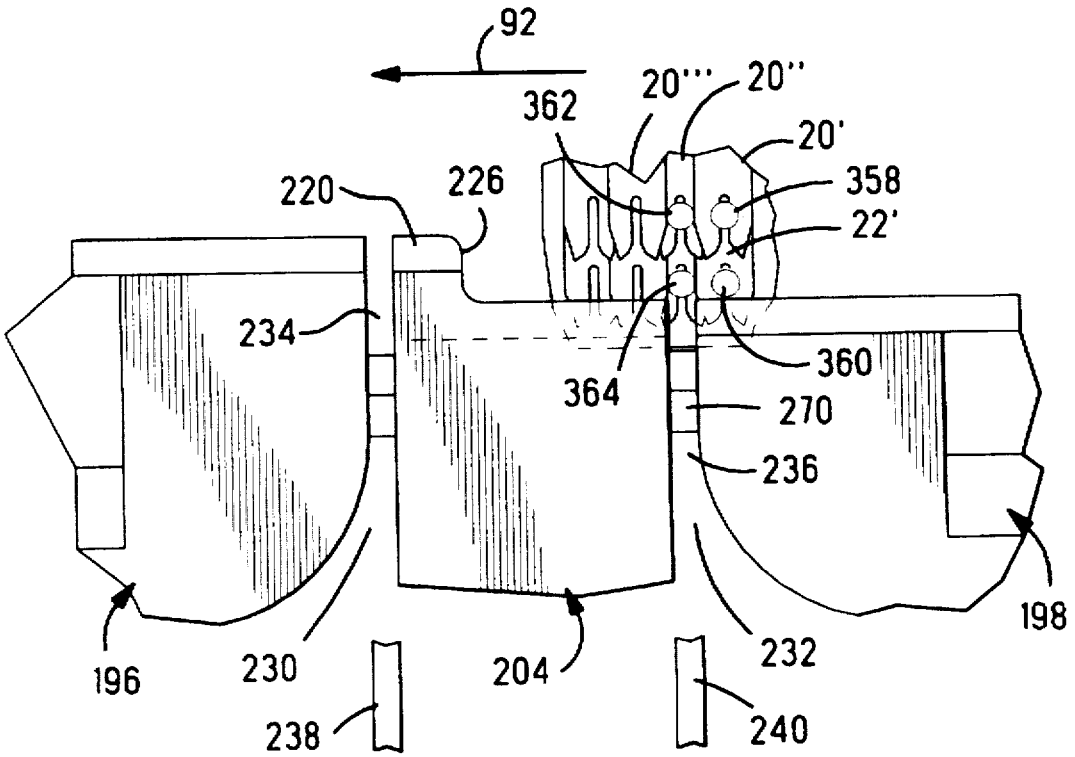
Figure 22:
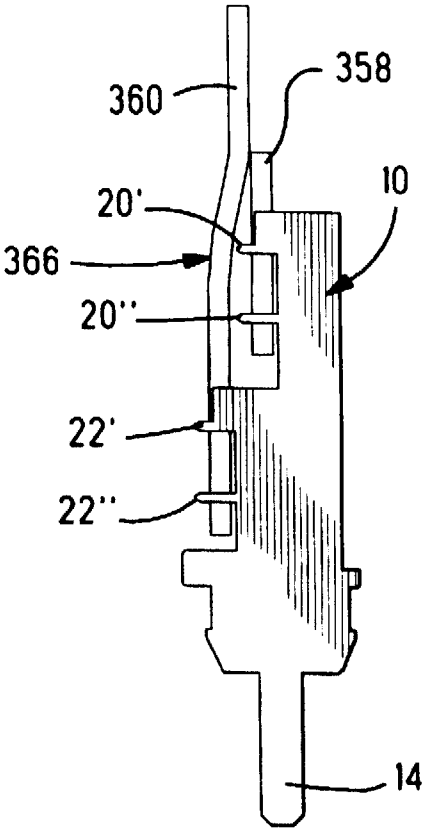
FIGS. 21 and 22 are front and end views, respectively, of a portion of the connector showing two terminated wires.
Figure 21:
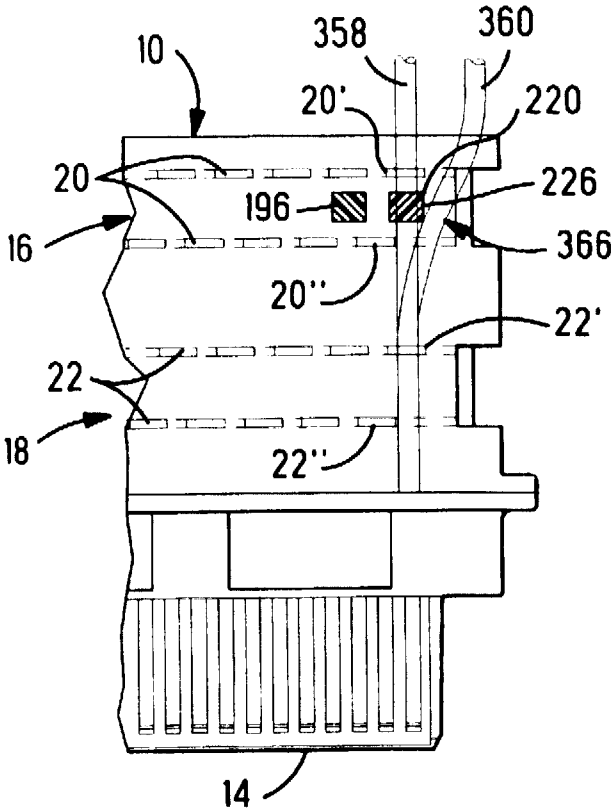

In operation, the two arms 328 are moved apart to the positions shown in FIG. 14 and the connector 10 is then inserted vertically into the left and right nests 306 and 308. As the connector first engages the nests, the top of the right nest 30 pivots slightly to the right, as indicated by the arrow, to allow the connector to easily enter. As the connector slides downwardly to its fully seated position, as shown in FIG. 15, the right nest 308 pivots back under the urging of the spring 342, in the direction of the arrow 354, shown in FIG. 14, until it engages the side of the connector and urges it into locating engagement with the non-pivoting left nest 306. The two arms 328 are then slid toward the connector 10 so that the ball plungers 344 engage the indentations 346 and the hold down fingers 330 engage the opposite upper edges of the connector. When doing so, the arms may be pivoted slightly away from each other to slightly raise the hold down fingers 330 so that they overlap the connector's edges. When released, the two arms 328 pivot toward the connector under the urging of their springs 342 and firmly hold the connector in position within the nests 306 and 308, as shown in FIGS. 15 and 16. As viewed in FIG. 3, the carriage 46 is moved toward the right until the connector 10 is positioned directly adjacent the wire insertion mechanism 44 and the right most contact 20' of the row 16 is in alignment with the left insertion blade 238, as shown in FIG. 17. A desired first pair of left and right wires 358 and 360, respectively, are selected from the cable 98 and moved into the respective left and right passageways 234 and 236 until they engage wire sensors that indicate that the wires are fully seated, as shown in FIG. 17. The sensors cause the left cylinder 162 to extend its piston rod and the left inserter 128 so that the left insertion blade 238 moves into the left passageway 234, picking up the first left wire 358 and carrying it into engagement with the lower wire shear 270 thereby severing the wire to length, and fully inserting the severed end in the right most or first contact 20' of the row 16. The left cylinder then retracts the left insertion blade 238 and, concurrently, the carriage 46 is moved to the right in the direction of the arrow 90 so that the right most or first contact 22' in the row 18 is in alignment with the right insertion blade 240, as shown in FIG. 18. The right cylinder 164 is then actuated to extend its piston rod and the right inserter 130 so that the right insertion blade 240 moves into the right passageway 236, picking up the first right wire 360 and carrying it into engagement with the lower wire shear 270 thereby severing the wire to length, and fully inserting the severed end in the first contact 22' of the row 18. The right cylinder then retracts the right insertion blade 240 and, concurrently, the carriage 46 is moved to the left in the direction of the arrow 92 so that the second contact 20" in the row 16 is in alignment with the left insertion blade 238, as shown in FIG. 19. As the carriage 46 is moving toward the left the wire deflection surface 226 engages a portion of the already inserted wire 360, deflecting it to the position shown at 366 in FIGS. 21 and 22. This allows the projection 220 to remain as close to the second contact 20''' as possible, thereby providing support and guidance for the next wire while it is in the left passageway 234, most importantly, without damaging the wire 360 or its termination to the first contact 22'. A second pair of left and right wires 362 and 364, respectively, are then selected and moved into the respective left and right passageways 234 and 236 until they engage the wire sensors, as shown in FIG. 19. The left cylinder 162 is again actuated to extend its piston rod and the left inserter 128 so that the left insertion blade 238 moves into the left passageway 234, picking up the second left wire 362 and carrying it into engagement with the lower wire shear 270 thereby severing the wire to length, and fully inserting the severed end in the second contact 20" of the row 16. The left cylinder then retracts the left insertion blade 238 and, concurrently, the carriage 46 is moved to the right in the direction of the arrow 90 so that the next or second contact 22" in the row 18 is in alignment with the right insertion blade 240, as shown in FIG. 20. The right cylinder 164 is again actuated to extend its piston rod and the right inserter 130 so that the right insertion blade 240 moves into the right passageway 236, picking up the second right wire 364 and carrying it into engagement with the lower wire shear 270 thereby severing the wire to length, and fully inserting the severed end in the second contact 22''' of the row 18. The right cylinder then retracts the right insertion blade 240 and, concurrently, the carriage 46 is moved to the left in the direction of the arrow 92 so that the third contact 20''' in the row 16 is in alignment with the left insertion blade 238, and the process is repeated until all wires are terminated to the connector 10.

An important advantage of the present invention is that wires may be terminated to two offset rows of contacts positioned on the same side of a connector housing wherein the contacts are arranged in aligned pairs. Additionally, very small center to center contact spacing is accommodated and will allow insertion of the wires in seriatim while preventing damage to adjacent wires already inserted.

We claim:

1. A machine for inserting discrete wires of a cable into pluralities of first and second insulation displacement contacts of an electrical connector, wherein said first contacts are arranged in a first row and said second contacts are arranged in a second row spaced from said first row and extending from a common side thereof so that said second contacts of said second row extend from said common side further than do said first contacts of said first row, said machine comprising:

(a) a frame;

(b) a first inserting mechanism having a first insertion blade movable in a first direction for effecting said inserting discrete wires into said first contacts of said first row;

(c) a second inserting mechanism adjacent to and spaced from said first inserting mechanism and having a second insertion blade movable in said first direction for effecting said inserting discrete wires into said second contacts of said second row;

(d) a holder slidingly coupled to said frame and arranged to hold and incrementally move said connector in second and third opposite directions along a pathway perpendicular to said first direction to momentarily position each said first contact in said first row in alignment with said first insertion blade and to momentarily position each said second contact in said second row in alignment with said second insertion blade during said inserting discrete wires.

2. The machine according to claim 1 including first and second inlet guides associated with said first and second inserting mechanisms, respectively, so that when a first wire of a pair of wires is moved into said first inlet guide and a second wire of said pair of wires is moved into said second inlet guide and said machine is operated, said first wire is inserted into a first contact in said first row and said second wire is inserted into a second contact in said second row, said first and second contacts being a pair of contacts.

3. The machine according to claim 2 wherein said first and second contacts of said pair of contacts are in mutual vertical alignment.

4. The machine according to claim 2 wherein said holder is arranged to move in said third direction to position said first insertion blade in alignment with a said first contact in said first row and to move in said second direction to position said second insertion blade in alignment with a said second contact in said second row.

5. The machine according to claim 4 including a guide member between said first and second insertion blades having a first guide surface adjacent said first insertion blade for guiding said first wire during insertion thereof and a second guide surface opposite said first guide surface arranged to engage and laterally move a portion of an adjacent previously inserted second wire when said holder is moved in said third direction.

6. The machine according to claim 5 including a lower shear member on opposite sides of said guide member arranged to cooperate with cutting edges on each of said first and second insertion blades for severing said first and second wires, respectively, to a desired length.

7. The machine according to claim 5 wherein said first inlet guide includes a drag member urged by a resilient member into interfering engagement with a said first wire in said first inlet guide so that said first wire is held in alignment between said first insertion blade and said first contact.

8. The machine according to claim 7 wherein said interfering engagement with said first wire is effected by said drag member urging said first wire against a portion of said first guide surface.

9. The machine according to claim 1 wherein said holder is slidingly coupled to said frame by means of a carriage that is attached to movable portions of two spaced apart slides, the stationary portions of which are attached to said frame, said holder being attached to said carriage.

10. The machine according to claim 9 including a motor in driving engagement with a lead screw that is in coupled engagement with said carriage, so that upon rotation of said lead screw clockwise said carriage is caused to move in one of said second and third directions and upon rotation of said lead screw counterclockwise said carriage is caused to move in the other of said second and third directions.

11. The machine according to claim 10 including a clamp for holding and positioning said cable vertically above said holder.

12. The machine according to claim 9 wherein said holder comprises: a holder frame; a connector nest consisting of a left nest portion rigidly attached to said holder frame and having a locating surface, and a right nest portion coupled to said holder frame and arranged to move toward said locating surface under the urging of a resilient member so that when a said electrical connector is inserted between said left and right nest portions, said connector is urged against said locating surface.

13. The machine according to claim 12 wherein said coupling of said right nest portion to said holder frame is effected by means of a pivotal coupling and said movement of said right nest portion is pivotal movement.

14. The machine according to claim 13 including left and right arms associated with said left and right nest portions, respectively, each said arm having a projection extending vertically above its respective nest portion and engageable with a said electrical connector positioned in said connector nest for retaining said connector therein, said left and right arms being slidable away from said connector thereby permitting removal of said connector from said connector nest and toward said connector for retaining said connector captive in said connector nest.

15. The machine according to claim 14 wherein each said left and right arm is pivotally coupled to its respective left and right nest portion and including resilient members arranged to urge each said arm to pivot toward said connector.

16. The machine according to claim 9 including a guide member between said first and second insertion blades having a first guide surface adjacent said first insertion blade for guiding said first wire during insertion thereof and a second guide surface opposite said first guide surface arranged to engage and laterally move a portion of an adjacent previously inserted second wire when said holder is moved in said second direction.

* * * * *